US007156725B2

(12) United States Patent
Togawa et al.

(10) Patent No.: US 7,156,725 B2
(45) Date of Patent: Jan. 2, 2007

(54) SUBSTRATE POLISHING MACHINE

(75) Inventors: Tetsuji Togawa, Kanagawa (JP); Ikutaro Noji, Kanagawa (JP); Keisuke Namiki, Kanagawa (JP); Hozumi Yasuda, Kanagawa (JP); Shunichiro Kojima, Kanagawa (JP); Kunihiko Sakurai, Kanagawa (JP); Nobuyuki Takada, Kanagawa (JP); Osamu Nabeya, Kanagawa (JP); Makoto Fukushima, Kanagawa (JP); Hideki Takayanagi, Tokyo (JP)

(73) Assignee: Ebara Corporation, Tokyo (JP)

( * ) Notice: Subject to any disclaimer, the term of this patent is extended or adjusted under 35 U.S.C. 154(b) by 101 days.

(21) Appl. No.: 10/481,591

(22) PCT Filed: Jul. 10, 2002

(86) PCT No.: PCT/JP02/06979

§ 371 (c)(1),
(2), (4) Date: May 26, 2004

(87) PCT Pub. No.: WO03/006206

PCT Pub. Date: Jan. 23, 2003

(65) Prior Publication Data

US 2004/0209560 A1 Oct. 21, 2004

(30) Foreign Application Priority Data

Jul. 10, 2001 (JP) ..... 2001-209575

(51) Int. Cl.
*B24B 29/00* (2006.01)
*B24B 5/00* (2006.01)

(52) U.S. Cl. ..... 451/285; 451/41; 451/286; 451/287; 451/288

(58) Field of Classification Search ..... 451/41, 451/285, 286, 287, 288
See application file for complete search history.

(56) References Cited

U.S. PATENT DOCUMENTS

| | | | | |
|---|---|---|---|---|
| 5,205,802 | A | 4/1993 | Swisher | |
| 5,605,488 | A | 2/1997 | Ohashi et al. | |
| 5,820,448 | A * | 10/1998 | Shamouilian et al. | 451/287 |
| 6,068,549 | A * | 5/2000 | Jackson | 451/398 |
| 6,241,593 | B1 | 6/2001 | Chen et al. | |

FOREIGN PATENT DOCUMENTS

| | | |
|---|---|---|
| JP | 8-39422 | 2/1996 |
| JP | 10-551 | 1/1998 |
| JP | 10-180626 | 7/1998 |
| JP | 11-226865 | 8/1999 |
| JP | 2000-288923 | 10/2000 |

* cited by examiner

*Primary Examiner*—Joseph J. Hail, III
*Assistant Examiner*—Shantese McDonald
(74) *Attorney, Agent, or Firm*—Westerman, Hattori, Daniels & Adrian, LLP.

(57) ABSTRACT

There is provided a substrate polishing machine which comprises a polishing surface and a substrate carrier for holding a substrate and bringing it into contact with the polishing surface. The substrate carrier comprises a carrier body, a substrate holding member for holding a substrate with a surface of the substrate to be polished being directed towards the polishing surface. The substrate holding member is mounted on the carrier body in such a manner that the substrate holding member is movable both towards and away from the polishing surface. The substrate polishing machine further comprises a substrate holding member positioning device provided on a side of the substrate holding member opposite to that used for holding the substrate. The substrate holding member positioning device has a flexible member which defines a chamber, and which, upon introduction of a non-compressible fluid, is expanded in a direction towards the polishing surface.

5 Claims, 7 Drawing Sheets

40
42
1
44
43
41
2
1a
39
11
12
38
W
51
52
53
54
50
10
13
14
15
16

SUBSTRATE POLISHING MACHINE

TECHNICAL FIELD

This invention relates to a polishing apparatus for polishing a substrate such as a semiconductor wafer.

BACKGROUND ART

In a conventional apparatus used for chemical-mechanical polishing of substrates, a substrate holding apparatus is used to hold a substrate and press it against a polishing surface. To prevent the substrate from becoming displaced from the substrate holding apparatus during a polishing operation, a retainer ring is provided around the substrate.

To perform consistent polishing of a substrate surface, it is preferable to maintain the retainer ring in a fixed position facing the polishing surface. However, in the conventional art, the retainer ring comes into contact with the polishing surface during a polishing operation, and is therefore subject to frictional wear. As polishing progresses an amount of frictional wear of the ring increases, which makes it difficult to maintain the ring in a desired fixed position relative to the polishing surface.

DISCLOSURE OF INVENTION

The present invention comprises a substrate polishing machine which includes a substrate carrier. The carrier comprises a carrier body and a substrate holding member. The substrate holding member is designed to hold a substrate in such a way that a surface of the substrate to be polished faces a polishing surface of the substrate polishing machine. The substrate holding member is mounted on the carrier body so as to be movable, relative to the carrier body, both towards and away from the polishing surface. A substrate holding member positioning device is provided on a side of the substrate holding member opposite to that used for holding the substrate. The substrate holding member positioning device includes an expandable member which defines a chamber, and the expandable member is connected to the substrate holding member. A non-compressible fluid is introduced into the chamber to expand it in a direction towards the polishing surface, thereby enabling the expandable member to be positioned as required relative to the carrier body.

Specifically, the carrier body has a retainer ring which is formed to be integral with the carrier body, and which surrounds the substrate held by the substrate holding member. By adjusting an amount of non-compressible fluid introduced into the expandable member, the substrate can be adjustably positioned relative to the retainer ring. The expandable member is provided in fluid-tight connection with the substrate holding member, and defines the chamber. The substrate polishing machine may further comprise a tank into which a non-compressible fluid can be introduced. The tank is fluidly connected to the chamber. Preferably, the non-compressible fluid is supplied to the chamber of the expandable member under its own weight. The substrate holding member positioning device is also preferably provided with an air exhaust port positioned at an uppermost position in the chamber.

Still further, the substrate polishing machine may include a seal ring which is positioned inside the retainer ring, and provided on and extending along the peripheral edge of the substrate holding member. A substrate is held by the substrate holding member in sealing engagement with the seal ring, to thereby define a sealed chamber. The sealed chamber is provided with at least one member to define a plurality of chambers, which can be independently supplied with fluids under desired pressures.

BEST MODE FOR CARRYING OUT THE INVENTION

Figure 1:
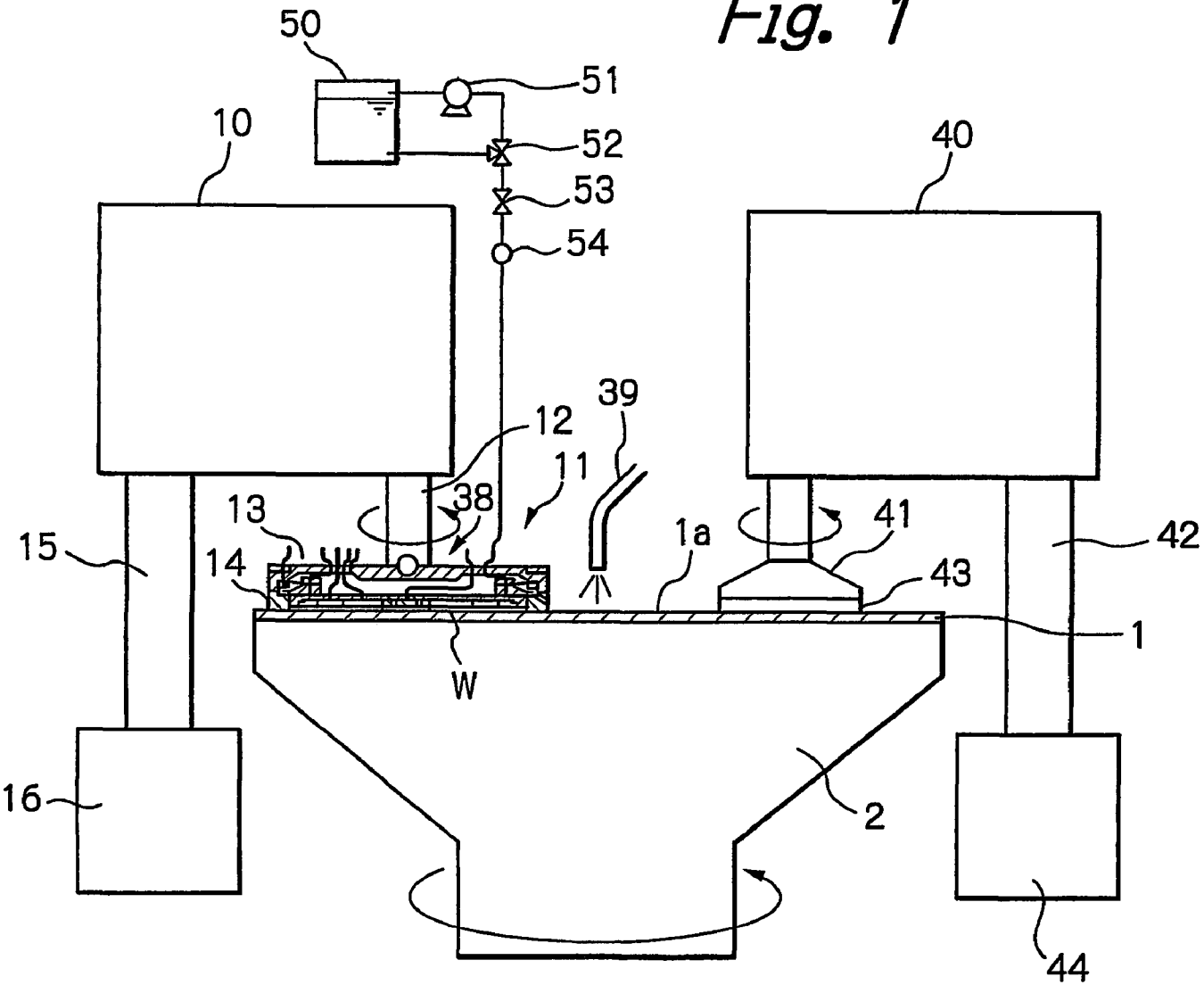
FIG. 1 is a schematic view, partly in section, of a substrate polishing machine according to the present invention.

An embodiment of the present invention will now be explained with reference to the drawings. First, a substrate polishing machine according to the present invention will be explained. FIG. 1 shows a structure of a substrate polishing machine according to the present invention. As shown in FIG. 1, the substrate polishing machine comprises a rotatable turntable 2 on the upper surface of which there is mounted a polishing member 1 (typically a polishing pad or bonded abrasive) having a polishing surface 1*a;* a substrate carrier unit 10 having a substrate carrier 11; and a dresser unit 40 having a dresser head 41.

The substrate carrier 11 is supported by a drive shaft 12 which is capable of moving both rotatively and in a vertical direction. The substrate carrier 11 holds a substrate W and, under action of the drive shaft, presses (a surface to be polished of) the substrate against the polishing surface 1*a* of the polishing member 1 while being rotated. The substrate W is polished when the turntable 2 starts to rotate. A polishing fluid is supplied onto the polishing surface 1*a* through a polishing fluid supply nozzle 39. The drive shaft 12 is movable in a vertical direction by means of an air cylinder (not shown). A retainer ring 14 is positioned under the periphery of a substrate carrier body 13 of the substrate carrier unit 10, and is pressed against the polishing surface 1*a* under a force generated by the air cylinder.

Moreover, the underside of the substrate carrier body 13 is provided with a plurality of coaxially arranged pressure chambers (explained later). These pressure chambers are designed so as to be able to be independently supplied with a pressurized fluid, and to thereby independently exert a pressure on a substrate being polished so as to maintain a desired profile of the substrate (explained later).

Dresser head 41 is supported by a pivotal shaft 42 to be both rotatable and movable in a vertical direction. In a dressing operation, the pivotal shaft 42 is lowered until the dressing member 43 comes into contact with the polishing surface 1*a* of the polishing member 1, and is then rotated.

This rotation together with rotation of the turntable 2 enables the configuration of the surface 1*a* of the member 1 to be restored and dressed.

A pivotal motor 16 is drivingly connected to a pivotal shaft 15, to enable the substrate carrier unit 10 to be pivoted in a horizontal direction, and the substrate carrier 11 to be moved to a desired position. A pivotal motor 44 is also drivingly connected to a pivotal shaft 42 to enable the dresser unit 40 to be pivoted in a horizontal direction, and the dresser head 41 to be moved to a desired position.

Figure 2:
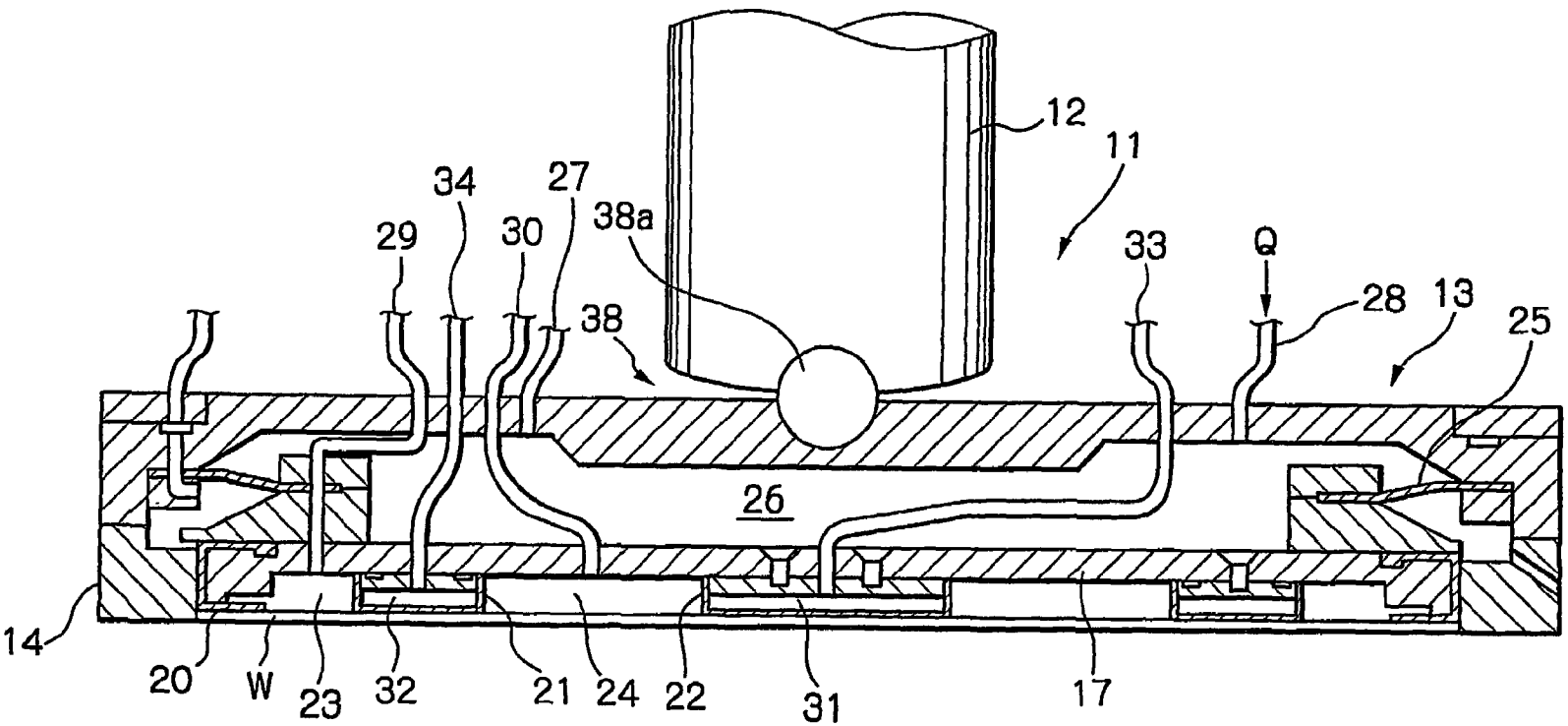
FIG. 2 is a schematic sectional view of a substrate carrier of a substrate holding apparatus according to the present invention.

Next, the substrate carrier 11 will be explained. FIG. 2 shows a structure of the carrier 11. The substrate carrier 11 comprises, as shown in FIG. 2, a retainer ring 14 provided on the underside of the periphery of the substrate carrier body 13, and a chucking plate 17 which is able to move in a vertical direction relative to the body 13. The carrier body 13 and the drive shaft 12 are connected by a universal joint 38. The universal joint 38 has a ball bearing mechanism which includes a ball element 38*a* for tiltably supporting the substrate carrier body 13 at a lower edge of the drive shaft 12, and a rotation transmitting mechanism (not shown) which transmits rotation of the drive shaft 12 to the substrate carrier body.

On the lower surface of the chucking plate 17, there are provided a sealing ring 20 around the periphery of the chucking plate, a circular center bag 22 at the center of the same, and a ring tube 21 positioned between and spaced apart from the sealing ring 20 and the circular center bag 22. The sealing ring 20, the center bag 22 and the circular tube 21 are made of elastic films. The center bag 22 and the circular tube 21 have pressure chambers 31 and 32, respectively. When a wafer W is held by the substrate carrier, the sealing ring 20 is sealingly engaged with the periphery of the wafer, and the center bag 22 and the circular tube 21 are also sealingly engaged with the wafer, thereby forming additional pressure chambers 23 and 24 between the sealing ring 20 and the circular tube 21, and between the circular tube 21 and the center bag 22, respectively.

Pressure supply conduits 29, 30, 33 and 34 are connected to the pressure chambers 23, 24, 31 and 32, respectively, so as to make it possible to control pressures in the pressure chambers 23, 24, 31 and 32, independently. This enables respective areas of the substrate corresponding to the pressure chambers to be polished under pressing forces which have been appropriately adjusted, and in this way the entire surface of the substrate can be polished to a high degree of planarity.

The chucking plate 17 is connected to the substrate carrier body 13 via the pressure sheet 25 made of an elastic film to be movable in a vertical direction. Above the chucking plate a fluid-tight chamber 26 is formed. The chucking plate 17 is structured to be movable in a vertical direction relative to the substrate carrier body 13 so that a position of the body 13 and the retainer ring 14, relative to the chucking plate 17, can be changed depending on an amount of abrasion of the retainer ring 14.

The fluid-tight chamber 26 is connected to a non-compressible fluid supply conduit 28. The conduit 28 supplies non-compressible fluid into the chamber 26 to prevent the chucking member 17 from moving upwards when an upper pressure is applied to the chucking member when the substrate W held by the substrate carrier is pressed against the polishing surface of the turntable during a polishing operation. To prevent any residual air being left in the chamber 26 when the non-compressible fluid is filled into the chamber 26, an air vent conduit 27 is fluidly connected to the chamber 26. This enables the chucking plate 17 to be kept at a predetermined position relative to the carrier body 13 even in a case that the chucking plate 17 is subject to an upward acting force.

Figure 4:
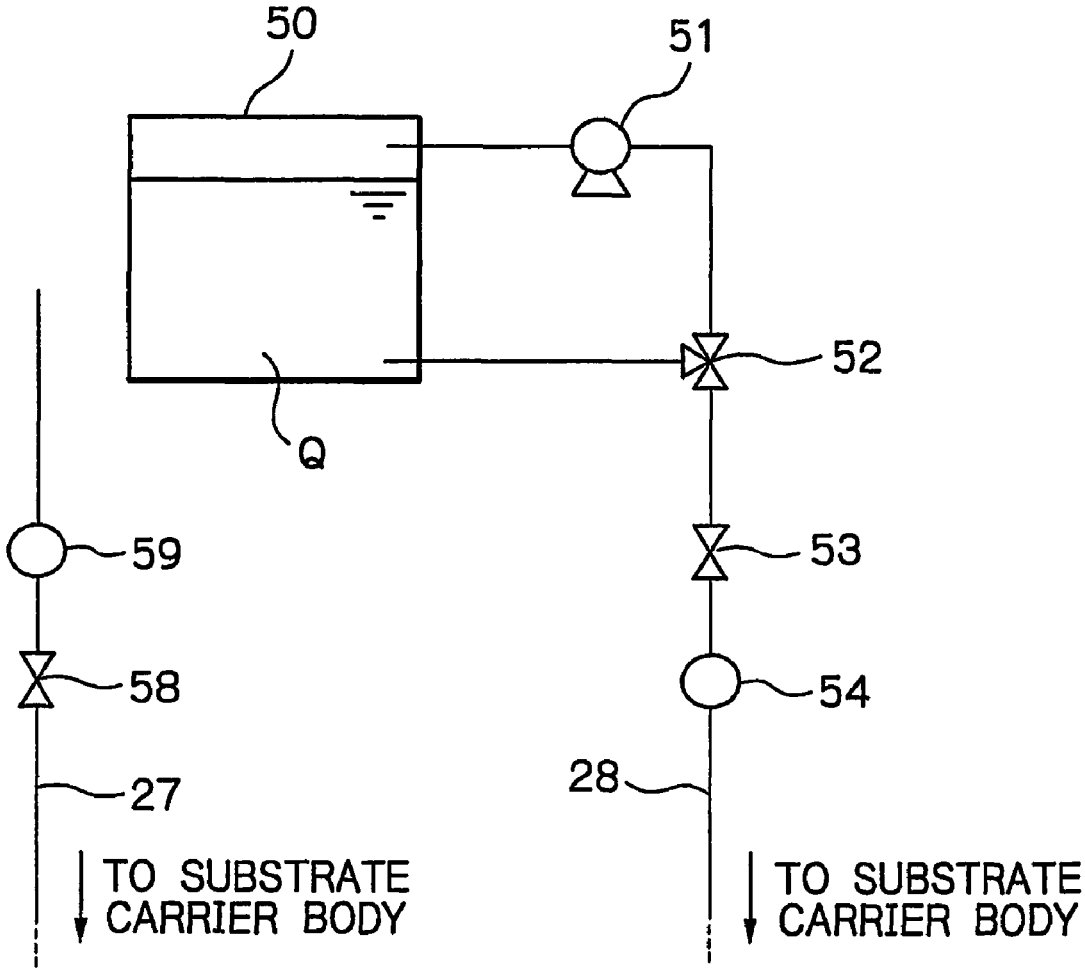
FIG. 4 is a schema of a pure water supply mechanism of a substrate holding apparatus according the present invention.

FIG. 4 illustrates a fluid supply system for filling the fluid-tight chamber 26 with a non-compressible fluid or pure water Q. When a substrate carrier 11 is assembled, the fluid-tight chamber 26 is filled with air. To discharge air from the chamber 26 for replacement with a non-compressible fluid, a valve 58 of the air vent conduit 27 is opened while the pure water Q is supplied into the fluid-tight chamber 26 via the pure water supply conduit 28. Upon filling the fluid-tight chamber 26, the pure water Q flows into the air vent conduit 27. The conduit is monitored by a flow meter 59 (shown in FIG. 4), to enable the valve 58 of the path 27 to be closed and the supply of pure water Q to be stopped when the flow meter 59 detects that the pure water Q has flown into the air vent conduit 27.

Figure 3:
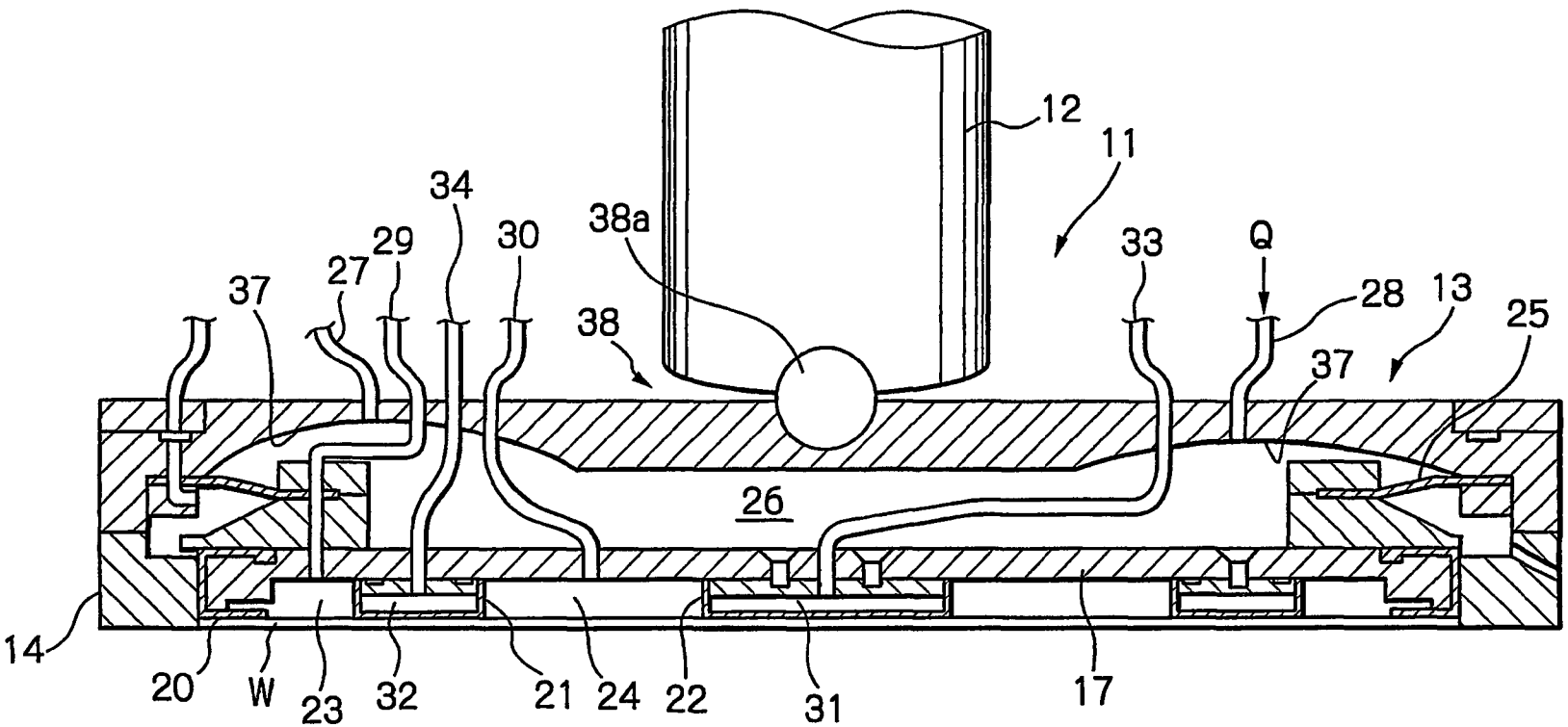
FIG. 3 is a schematic sectional view of a substrate carrier of another substrate holding apparatus according to the present invention.

To ensure complete discharge of air from the fluid-tight space 26, the upper wall of the fluid-tight chamber 26 is formed to have an convex surfaces 37, as shown in FIG. 3, so as to enable air in the chamber to be discharged from an area of the chamber, which is highest, through the air vent conduit 27.

As shown in FIG. 4, the pure water supply system comprises a pure water tank 50, a pump 51, a three-directional valve 52, a valve 53 and a flow meter 54. In a case that the pure water Q to be supplied to the fluid-tight chamber 26 is pressurized, an excessive force may be imparted to the substrate W to be polished. It is therefore preferable that pure water be supplied to the chamber at a pressure which is close to atmospheric pressure. This is achieved by supplying the pure water Q to the fluid-tight chamber 26 under its own weight from the pure water tank 50, which is provided at a position higher than that of the substrate carrier 11. The pump 51 is actuated only when it is necessary to pump the pure water Q in an upward direction from the fluid-tight chamber 26. Thus, by enabling down flow of pure water Q under gravity and, as required, pumping it in an upward direction from the chamber, the volume of the fluid-tight chamber 26 can be appropriately controlled.

Figure 5:
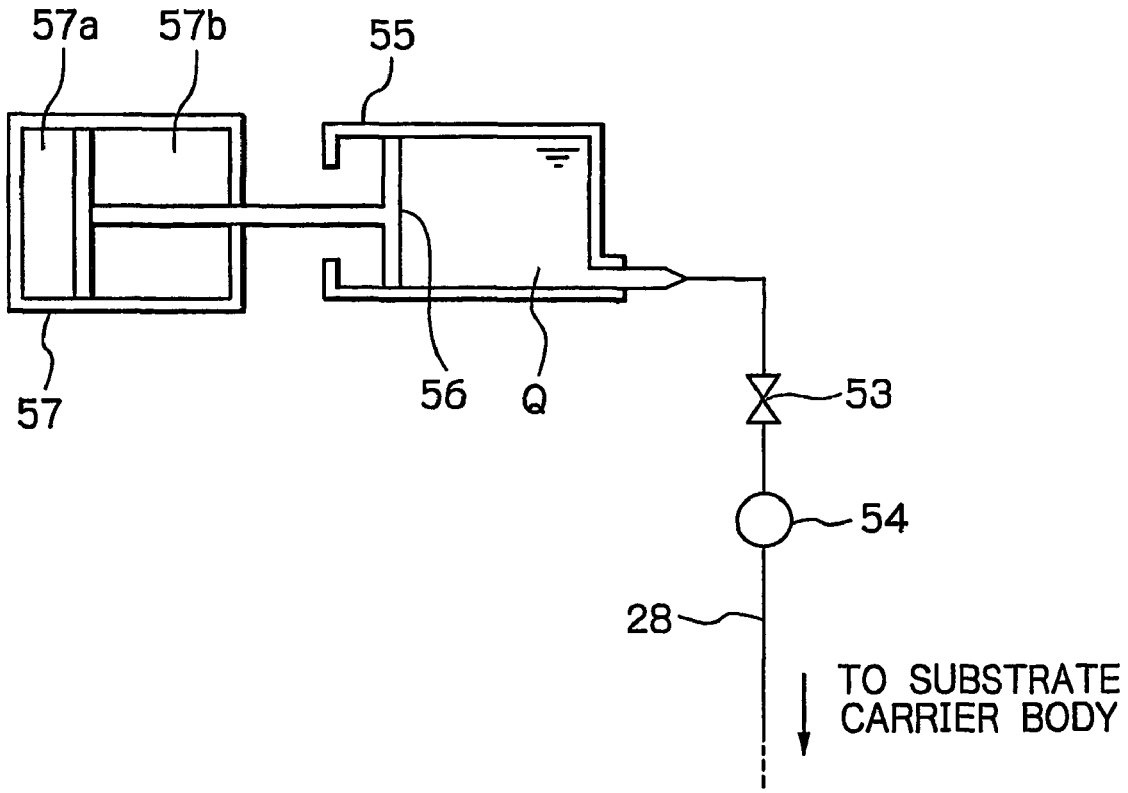
FIG. 5 is a schema of another pure water supply mechanism of a substrate holding apparatus according to the present invention.
Figure 6:
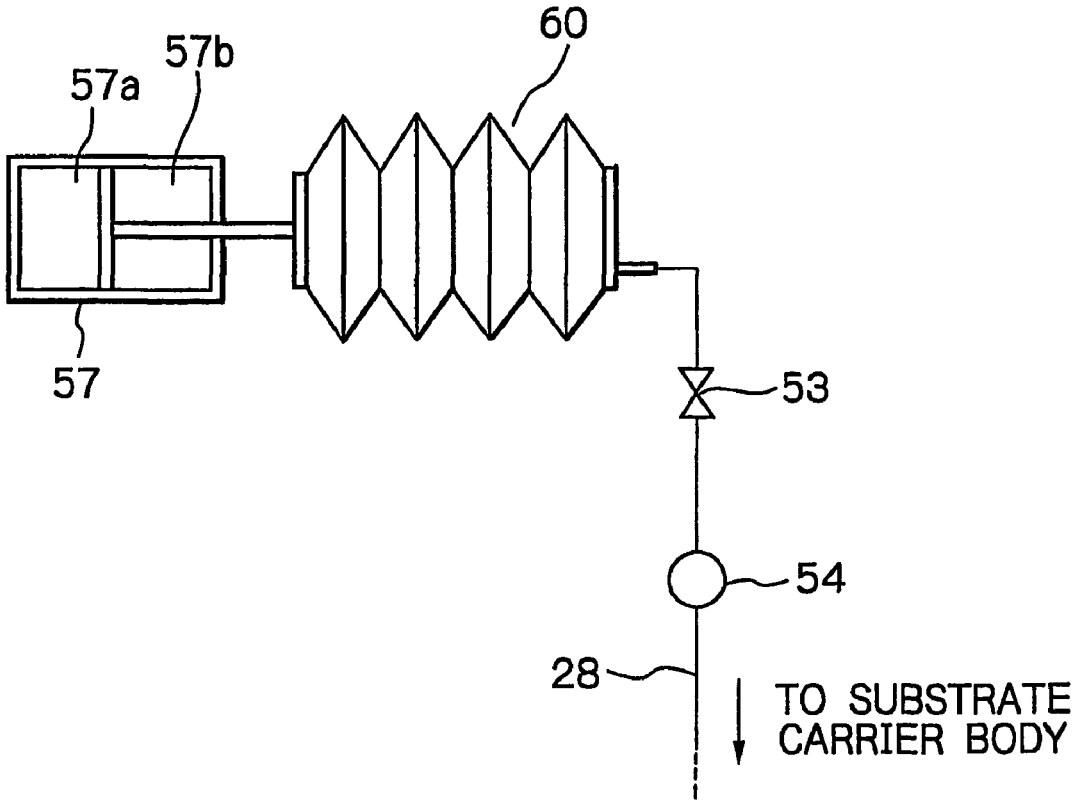
FIG. 6 is a schema of yet another pure water supply mechanism of a substrate holding apparatus according to the present invention.

A pure water supply system which supplies pure water Q to the fluid-tight space 26 may also be structured as shown in FIG. 5. In this case, a pure water tank 55 is provided with a piston 56 which is slidable within the tank. The piston 56 is driven by an air cylinder 57, or the like. To prevent pressurization of the pure water Q, air should be supplied to a drive chamber 57*a* of the air cylinder 57 at a pressure which is slightly higher than an atmospheric pressure. When a chamber 57*b* of the air cylinder 57 is supplied with a pressurized air, the piston 56 is moved in a leftward direction to thereby pump the pure water Q from the fluid-tight chamber 26. The pure water tank 55, as provided in the pure water supply system shown in FIG. 5, may be replaced with a pure water tank 60 having a bellows configuration, as shown in FIG. 6.

Operation of the subject polishing machine will now be explained. First, the substrate carrier 11 is pivoted around a pivotal shaft 15 to a position of a substrate delivery device (not shown). The carrier then receives a substrate W from the substrate delivery device, and holds it under suction. When holding the substrate W, the substrate carrier 11 is positioned such that the sealing ring 20 is sealingly engaged with the periphery of the upper surface of the wafer; the center bag 22 and the ring tube 21 are then expanded under introduction of a pressurized fluid which causes the lower surfaces of the center bag 22 and the ring tube 21 to sealingly engage with the upper surface of the substrate W. The substrate W is then held by a suction force produced in the chambers 23 and 24 upon connection of the chambers 23,24 to a vacuum source (not shown) via the respective fluid conduits 29, 30.

As stated above, after holding the substrate W, the carrier 11 is pivoted to a polishing position above the turntable 2, and is then lowered towards the polishing surface upon actuation of the air cylinder of the drive shaft 12. At this time, the size of the fluid-tight chamber 26 is adjusted such that the lower surface of the substrate W is positioned above the lower surface of the retainer ring 14.

As the substrate carrier 11 is lowered, the retainer ring 14 comes into contact with the polishing surface 1*a* of the polishing member 1. Upon contact, movement of the substrate carrier 11 towards the polishing surface is stopped. The valve 53 of the pure water supply conduit 28 is then opened to supply pure water Q to the fluid-tight chamber 26. Under monitoring by the flow meter 54, when the substrate W abuts the polishing surface 1*a,* the valve 53 is closed to thereby close the pure water supply path 28, and prevent further supply of pure water Q. Polishing is then conducted with pressurized fluids having been introduced into the pressure chambers 23, 24, 31 and 32. During the polishing operation, relative vertical positioning can be secured between the chucking plate 17 and the substrate carrier body 13, and, as a result stable and consistent polishing of the substrate W can be achieved.

After polishing is complete, pressure chambers 23 and 24 are again connected to a vacuum source to thereby hold the substrate W under the influence of a vacuum and the substrate carrier 11 is then lifted and pivoted above the substrate delivery device for delivery of the substrate W thereto.

Figure 7:
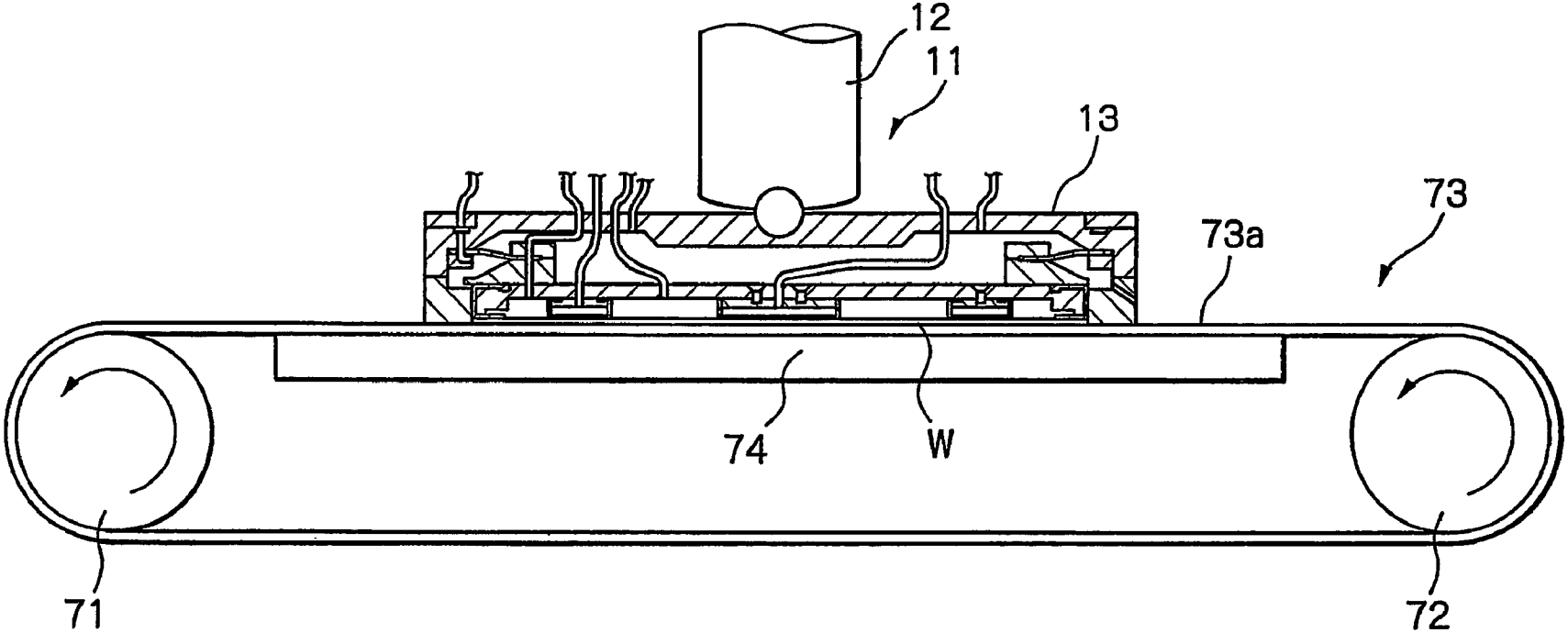
FIG. 7 is a schematic view, partly in section, of a substrate polishing machine according the present invention.

Referring to FIG. 7, there is shown another type of substrate polishing machine which has an endless belt 73 supported by a pair of rollers 71, 72, wherein a substrate W held by the carrier 11 is pressed against the polishing surface 73*a* of an upper run portion of the endless belt 73.

The upper run portion of the belt 73, against which the substrate W held by the carrier 11 is pressed, is supported by a belt supporting unit 74. In a polishing operation, the belt 73 is driven while the carrier 11 is rotated in the same way as described in the previous embodiment. During polishing, a polishing fluid is supplied onto the polishing surface 73*a* from a polishing nozzle (not shown).

Thus, according to the present invention, it is possible to set the substrate W at a position, as required, relative to a substrate carrier body 13 during a polishing operation.

Specifically, when a substrate held by the substrate carrier 11 is brought into contact with the polishing surface, the substrate is, as stated above, held at a position above the lower surface of the retainer ring so that the lower surface of the retainer ring first comes into contact with the polishing surface. Then, a non-compressive fluid or pure water is supplied to the fluid-tight space 26 so as to cause the substrate W to be moved in a downward direction, relative to the substrate carrier body 13, and also the retainer ring. When the substrate finally comes into contact with the polishing surface, supply of the non-compressible fluid or pure water is stopped. Consequently, a desired positional relationship between the retainer ring 14 and the substrate W can be maintained, even in a case that the retainer ring 14 has become abraded over time.

Moreover, the supply of the non-compressive fluid into the fluid-tight chamber 26 is effected with a force which is only slightly greater than an atmospheric pressure, under its own weight, whereby it is possible to bring the wafer into contact with the polishing surface without imposing any excessive force on the substrate.

Furthermore, in accordance with the present invention, the substrate carrier is provided with a plurality of pressure chambers 31, 24, 32 and 34 which are coaxially arranged, and which are able to be independently supplied with a pressurized fluid, thereby enabling the substrate W to be subjected to varying pressing forces generated respectively by the pressure chambers 31, 24, 32 and 34.

The invention claimed is:

1. A substrate polishing machine comprising:

a polishing surface; and a substrate carrier for holding a substrate and bringing it into contact with the polishing surface; the substrate carrier comprising:

a carrier body;

a substrate holding member for holding a substrate with a surface of the substrate to be polished directed towards the polishing surface; and a substrate holding member positioning device provided on the opposite side of the substrate holding member relative to the side of the same for holding the substrate, the substrate holding member positioning device including a flexible member connected between the substrate carrier body and the substrate holding member to define an expandable chamber therebetween, the expandable chamber being designed to be filled with a non-compressible fluid and to be extendible towards the polishing surface by filling a non-compressible fluid to adjustably position the substrate holding member relative to the carrier body;

a retainer ring which is integrally formed with the carrier body and is positioned to surround the substrate held by the substrate holding member, the substrate being adjustably positioned relative to the retainer ring by adjusting an amount of the non-compressible fluid filled in the expandable chamber;

a seal ring positioned inside the retainer ring and provided on and extending along the peripheral edge of the substrate holding member, the substrate held by the substrate holding member being sealingly engaged with the seal ring to cooperate with the seal ring and the substrate holding member to define a sealed chamber; and at least one member provided in the sealed chamber to define a plurality of chambers which can be independently supplied with fluids under desired pressures.

2. A substrate polishing machine as set forth in claim 1, further comprising a tank for reserving a non-compressible fluid therein and fluidly connected to the expandable chamber to fill the expandable chamber with the non-compressible fluid, wherein the non-compressible fluid in the tank is under the atmospheric pressure and supplied to the chamber of the expandable member under its own weight.

3. A substrate polishing machine as set forth in claim 2, further comprising a pump for pumping the non-compressible fluid from the expandable chamber.

4. A substrate polishing machine as set forth in claim 1, wherein said at least one member comprises:

a center inflatable chamber member mounted on the center of the substrate holding member in the sealed chamber and adapted to be subjected to a pressure so as to urge the center portion of the substrate held by the substrate holding member against the polishing surface; and an annular inflatable chamber member mounted on the substrate holding member in the sealed chamber and radially spaced apart from the center inflatable chamber member, the annular inflatable chamber member being adapted to be subjected to a pressure so as to urge an annular portion of the substrate spaced apart from the center portion of the same against the polishing surface;

wherein the sealed chamber is formed with separate annular sealed sections formed between the center inflatable chamber member and the annular inflatable chamber member and between the annular inflatable chamber member and the seal ring; and the separated annular sealed sections are adapted to be independently subjected to desired pressures.

5. A substrate polishing machine comprising:

a polishing surface; and a substrate carrier for holding a substrate and bringing it into contact with the polishing surface;

the substrate carrier comprising:

a carrier body;

a chucking plate for holding a substrate;

an elastic sheet connected between the carrier body and the chucking plate to define an expandable chamber which is designed to be filled with a non-compressible fluid to adjustably position the chucking plate relative to the carrier body;

a retainer ring which is integrally formed with the carrier body and is positioned to surround the substrate;

a seal ring positioned inside the retainer ring and provided on and extending along the peripheral edge of the chucking plate, the substrate held by the chucking plate being sealingly engaged with the seal ring to cooperate with the seal ring and the chucking plate to define a sealed chamber; and at least one member provided in the sealed chamber to define a plurality of chambers, which can be independently supplied with fluids under desired pressures.

* * * * *